US012478147B2

(12) United States Patent
Wang

(10) Patent No.: US 12,478,147 B2
(45) Date of Patent: Nov. 25, 2025

(54) FASTENING STRUCTURE

(71) Applicant: FIVEGRAND INTERNATIONAL CO., LTD., New Taipei (TW)

(72) Inventor: Ting-Jui Wang, New Taipei (TW)

(73) Assignee: FIVEGRAND INTERNATIONAL CO., LTD., New Taipei (TW)

( * ) Notice: Subject to any disclaimer, the term of this patent is extended or adjusted under 35 U.S.C. 154(b) by 0 days.

(21) Appl. No.: 18/482,034

(22) Filed: Oct. 6, 2023

(65) Prior Publication Data

US 2024/0122310 A1 Apr. 18, 2024

(30) Foreign Application Priority Data

Oct. 17, 2022 (TW) ..... 111139275

(51) Int. Cl.
*A44B 99/00* (2010.01)
*A44B 11/00* (2006.01)

(52) U.S. Cl.
CPC ..... *A44B 99/005* (2013.01)

(58) Field of Classification Search
CPC ..... A44B 99/005; A44B 11/00
See application file for complete search history.

(56) References Cited

U.S. PATENT DOCUMENTS 867,162 A * 9/1907 Seidl ..... A44C 5/22 403/349
1,648,062 A * 11/1927 Russell ..... A44B 11/00 24/DIG. 47
5,367,891 A * 11/1994 Furuyama ..... A44C 5/2057 63/3
5,368,427 A * 11/1994 Pfaffinger ..... F16B 21/04 24/DIG. 54
6,058,576 A * 5/2000 Harris ..... A44C 5/2057 24/616
6,357,090 B1 * 3/2002 Murai ..... A45C 13/126 24/593.1
6,883,211 B2 * 4/2005 Hoshino ..... A44C 5/2061 24/663
8,607,399 B2 * 12/2013 Umbrell ..... B24D 13/20 279/93
8,955,828 B2 * 2/2015 Campbell ..... H01R 13/625 256/10
9,351,544 B2 * 5/2016 Matsumori ..... A44C 5/2061
9,943,142 B1 * 4/2018 Thomsen ..... A44B 17/0076
10,945,494 B1 * 3/2021 Thomsen ..... A44C 5/2076
2016/0338455 A1 * 11/2016 Chuan ..... A44B 19/305
2017/0119108 A1 * 5/2017 Schlick ..... A44B 99/005
2019/0113828 A1 * 4/2019 Wine ..... F16B 2/12

FOREIGN PATENT DOCUMENTS

TW M590641 U 2/2020
TW I741828 B 10/2021
TW 202224511 A 6/2022

* cited by examiner

*Primary Examiner* — David M Upchurch

(57) ABSTRACT

A fastening structure includes a body section and a fastener. The body section is movably combined with the fastener, and the body section is provided with a limiting segment or an uplift segment. The fastener is provided with a corresponding section. The limiting segment is used to make the corresponding section located at a limiting position, or the uplift segment is used to make the corresponding section located at a lifting position.

15 Claims, 15 Drawing Sheets

FASTENING STRUCTURE

CROSS-REFERENCE TO RELATED APPLICATION

This non-provisional application claims priority under 35 U.S.C. § 119(a) on Patent Application No(s). 111139275 filed in Taiwan, R.O.C. on Oct. 17, 2022, the entire contents of which are hereby incorporated by reference.

BACKGROUND OF THE INVENTION

1. Field of the Invention

The present disclosure is related to a fastening structure, and in particular to a fastening structure that can provide stable combination and easy separation of an object and an attached object.

2. Description of the Related Art

Generally, when combining at least one object, it is usually achieved by locking with buckles to combine the objects, but because of the structural design of the buckle, it often occurs that the combined object is unstable and loose after combination, or the buckle is not easy to separate after combination.

BRIEF SUMMARY OF THE INVENTION

In view of the above prior art, the present disclosure provides a fastening structure that firmly combines an object and an attached object.

To achieve the above objective and other objectives, the present disclosure provides a fastening structure, including a body section and a fastener, the body section is movably combined with the fastener, and the body section is provided with a limiting segment or an uplift segment. The fastener is provided with a corresponding section. The limiting segment is used to make the corresponding section located at a limited position, or the uplift segment is used to make the corresponding section located at a lifted position.

In an embodiment of the fastening structure, the body section is provided with a blocking segment, the fastener is provided with a corresponding blocking segment, and the blocking segment and the corresponding blocking segment are used to limit movement.

In an embodiment of the fastening structure, the corresponding section is provided with a clasp section.

In an embodiment of the fastening structure, the fastener is provided with a shaft section, the shaft section is connected to the corresponding section, and the shaft section is provided with a clasp section.

In an embodiment of the fastening structure, the fastening structure further includes an elastic component, one end of the elastic component is abutted against the body section, and another end of the elastic component is abutted against the fastener.

In an embodiment of the fastening structure, the uplift segment is a concave section, a convex section, a groove section, a trench section, a plane section, a stepped face, an inclined face, or a curved section.

In an embodiment of the fastening structure, the corresponding section is lifted from the limiting segment, so that the fastener resists an elastic force of an elastic component, and when the corresponding section exceeds the limiting segment, the corresponding section is rotated to the uplift segment, in order to lift a clasp section.

In an embodiment of the fastening structure, the corresponding section is lifted to make the fastener rotate to the uplift segment, in order to lift a clasp section.

In an embodiment of the fastening structure, the corresponding section is lifted to make the fastener rotate to the uplift segment below a top surface of the body section, in order to lift a clasp section.

In an embodiment of the fastening structure, the corresponding section is lifted to make the fastener rotate to the uplift segment of a top surface of the body section, in order to lift the clasp section.

In an embodiment of the fastening structure, an external force is applied to the body section to make a connecting segment of the body section apply pressure to an object, so that the material of the object flows into or enters a material storage space of the connecting segment.

In an embodiment of the fastening structure, an external force is applied to the body section to make a connecting segment of the body section expand to an object.

In an embodiment of the fastening structure, the body section is provided with a connecting segment, the connecting segment has a solderable surface, and the solderable surface can be heated to solder to the object.

In an embodiment of the fastening structure, the body section is provided with a connecting segment, the connecting segment has an anti-rotation segment or a positioning segment, the anti-rotation segment or the positioning part is used to anti-rotate or position an object, for anti-rotating, positioning, or limiting a fastening position or fastening direction of a clasp section.

In an embodiment of the fastening structure, the corresponding section and a shaft section are combined by bolting, fastening, riveting, expanding, or integrally molding.

In an embodiment of the fastening structure, the limiting segment or the uplift segment is an open space passing through the body section, or the limiting segment or the uplift segment is an open space passing through a side wall of the body section.

In an embodiment of the fastening structure, the fastener is provided with a clasp section, and the clasp section is a convex fastening body, a threaded body, an inner fastening body, an elastic fastening body, or a cylinder body.

In an embodiment of the fastening structure, the fastener is provided with a clasp section, and the clasp section is a convex fastening body, and the clasp section passes through an attached section of an attached object, and rotates to a fastening position of the uplift segment.

In an embodiment of the fastening structure, the fastener is provided with a clasp section, and the clasp section is bolted with the corresponding section. The corresponding section rotates at the limiting segment to lift one side of the corresponding section to drive the clasp section up or in motion, or the corresponding section rotates at the limiting segment to lift one side of the corresponding section.

In an embodiment of the fastening structure, the corresponding section rotates at the limiting segment to lift one side of the corresponding section.

In an embodiment of the fastening structure, the limiting segment and the uplift segment are the same structure, or the limiting segment and the uplift segment are different structures.

In an embodiment of the fastening structure, the corresponding section presses an elastic component, so that the corresponding section enters the limiting segment, and an elastic force of the elastic component presses the limiting segment into a locking space for limiting.

In an embodiment of the fastening structure, the corresponding section presses an elastic component, so that the corresponding section enters the limiting segment, and an elastic force of the elastic component presses the limiting segment into a limiting space.

Accordingly, the fastening structure of the present disclosure can provide stable combination and easy separation of the object and the attached object.

DETAILED DESCRIPTION OF THE INVENTION

To facilitate understanding of the purpose, characteristics, and effects of the present disclosure, embodiments together with the attached drawings for the detailed description of the present disclosure are provided as below.

Figure 1:
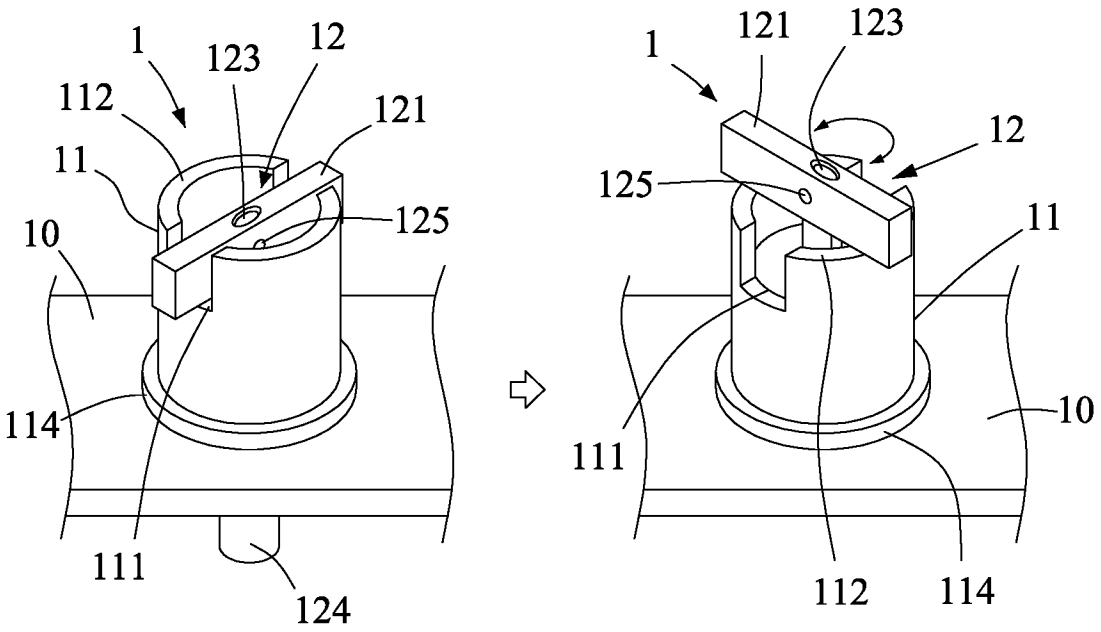
FIG. 1 is a schematic view of an operating state of an embodiment of the present disclosure.
Figure 2:
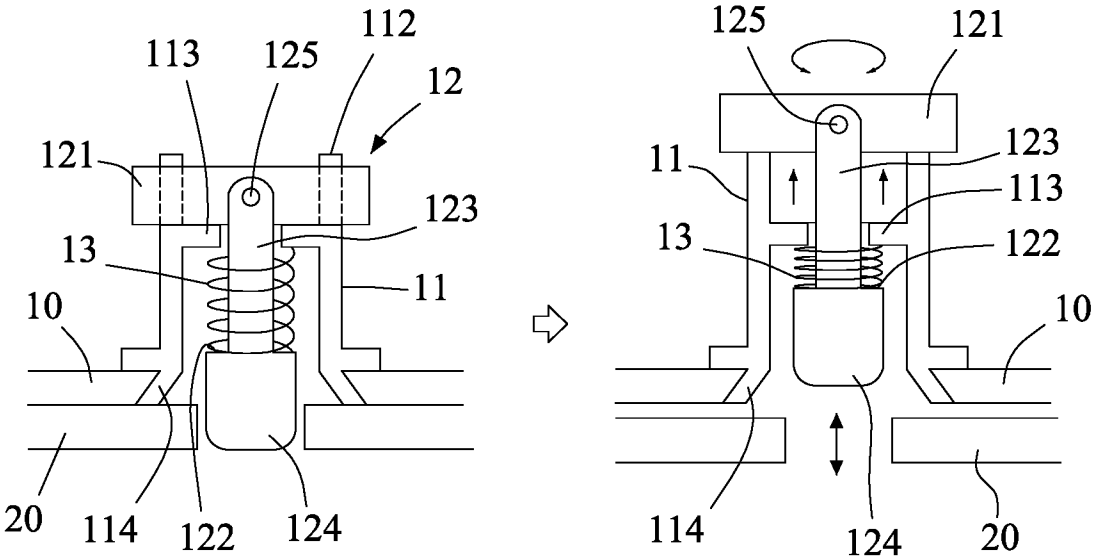
FIG. 2 is a schematic view of an operating state of an embodiment of the present disclosure.
Figure 3:
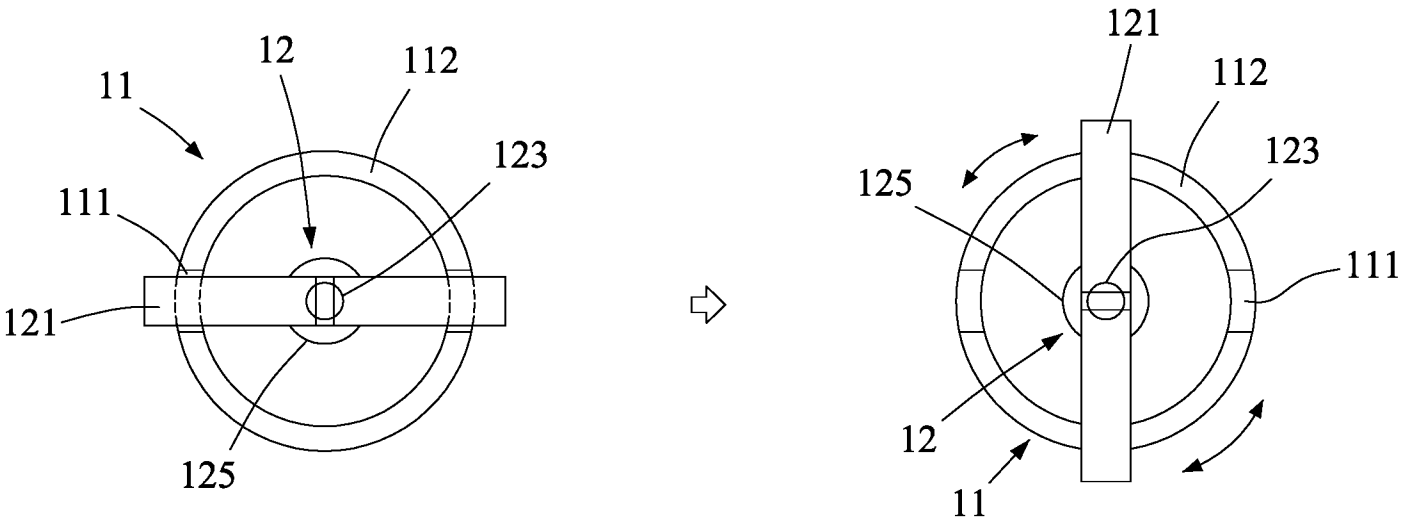
FIG. 3 is a schematic view of an operating state of an embodiment of the present disclosure.

Referring to FIGS. 1-3, the present disclosure comprises a fastening structure 1, including a body section 11 and a fastener 12. The body section 11 is movably combined with the fastener 12. The body section 11 is provided with a limiting segment 111 and an uplift segment 112. The fastener 12 is provided with a corresponding section 121. The limiting segment 111 is used to locate the corresponding section 121 at a limiting position. The uplift segment 112 is used to locate the corresponding section 121 at a lifting position.

When used, the body section 11 of the fastening structure 1 may be disposed on an object 10 by a connecting segment 114. When fastening and combining with an attached object 20, the corresponding section 121 of the fastener 12 may be moved to the limiting segment 111 from the uplift segment 112 to make the corresponding section 121 move from the lifting position to the limiting position, so that the corresponding section 121 is limited to the limiting segment 111, and the fastener 12 is fastened to the attached object 20 at the same time. Thus, the fastening structure 1 can provide stable combination of the object 10 and the attached object 20.

Further, to separate the attached object 20, the corresponding section 121 of the fastener 12 may be moved to the uplift segment 112 from the limiting segment 111 to make the corresponding section 121 move from the limiting position to the lifting position, so that the corresponding section 121 is lifted by the uplift segment 112, and the fastener 12 separates the attached object 20 at the same time. Thus, the fastening structure 1 can provide easy separation of the object 10 and the attached object 20.

In an embodiment of the present disclosure, the body section 11 is provided with a blocking segment 113 and the fastener 12 is provided with a corresponding blocking segment 122. The blocking segment 113 and the corresponding blocking segment 122 are used to limit movement. Thus, when the corresponding section 121 of the fastener 12 is moved to the limiting segment 111 or the uplift segment 112, the blocking segment 113 is used to cooperate with the corresponding blocking segment 122, in order to prevent the fastener 12 from being disengaged from the body section 11 because of the moving.

In an embodiment of the present disclosure, the fastener 12 is provided with a shaft section 123, the shaft section 123 is connected to the corresponding section 121, and the shaft section 123 is provided with a clasp section 124. Thus, the corresponding section 121 of the fastener 12 may be rotated to the limiting segment 111 from the uplift segment 112 to make the corresponding section 121 lower from the lifting position to move to the limiting position, so that the corresponding section 121 is limited to the limiting segment 111, and the clasp section 124 of the fastener 12 is fastened to the attached object 20 at the same time for fastening combination. Further, the corresponding section 121 may be lifted to make the fastener 12 rotate to the uplift segment 112, so that the corresponding section 121 is moved from the limiting position to the lifting position, in order to lift the clasp section 124 to separate from the attached object 20. Thus, the fastening structure 1 provides stable combination and an easy separation of the object 10 and the attached object 20.

In an embodiment of the present disclosure, the corresponding section 121 is lifted to make the fastener 12 rotate to the uplift segment 112 below a top surface of the body section 11, in order to lift the clasp section 124. Thus, the fastening structure 1 provides easy separation of the object 10 and the attached object 20.

In an embodiment of the present disclosure, the corresponding section 121 is lifted to make the fastener 12 rotate to the uplift segment 112 of a top surface of the body section 11, in order to lift the clasp section 124. Thus, the fastening structure 1 provides easy separation of the object 10 and the attached object 20.

In an embodiment of the present disclosure, the fastening structure further includes an elastic component 13, and one end of the elastic component 13 is abutted against the body section 11, and another end of the elastic component 13 is abutted against the fastener 12. In an embodiment, one end of the elastic component 13 is abutted against the blocking segment 113 of the body section 11, and the other end of the elastic component 13 is abutted against the corresponding blocking segment 122 of the fastener 12. Accordingly, when actuated, the corresponding section 121 may be lifted from the limiting segment 111, so that the fastener 12 resists an elastic force of the elastic component 13. When the corresponding section 121 exceeds the limiting segment 111, it is rotated to the uplift segment 112, in order to lift the clasp section 124 away from the attached object 20, and compress the elastic component 13. When fastened and combined with the attached object 20, the corresponding section 121 of the fastener 12 may be rotated to the limiting segment 111 at the uplift segment 112 to make the corresponding section 121 lower from the lifting position to move to the limiting position, the elastic component 13 is released in an stretched state at this time, so that the corresponding section 121 is limited to the limiting segment 111, and the clasp section 124 of the fastener 12 is fastened to the attached object 20 for fastening combination at the same time. Thus, the fastening structure 1 provides a stable combination of the object 10 and the attached object 20.

In an embodiment of the present disclosure, the uplift segment 112 is a concave section, a convex section, a groove section, a trench section, a plane section, a stepped face, an inclined face, or a curved section. Accordingly, the present disclosure can further meet the needs of practical applications.

In an embodiment of the present disclosure, the corresponding section 121 and the shaft section 123 are bolted and combined by a bolted segment 125, or the corresponding section 121 and the shaft section 123 are combined by fastening, riveting, expanding, or integrally molding. Accordingly, the present disclosure can further meet the needs of practical applications.

In an embodiment of the present disclosure, the limiting segment 111 and the uplift segment 112 are the same structure, or the limiting segment 111 and the uplift segment 112 are different structures. Accordingly, the present disclosure can further meet the needs of practical applications.

Figure 4:
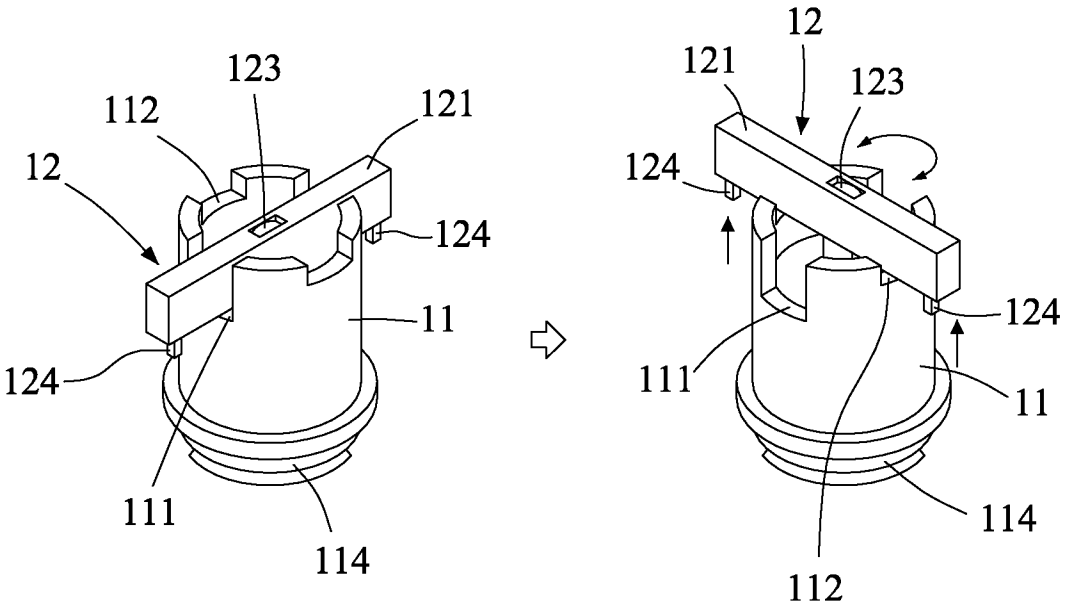
FIG. 4 is a schematic view of an operating state of an embodiment of the present disclosure.
Figure 5:
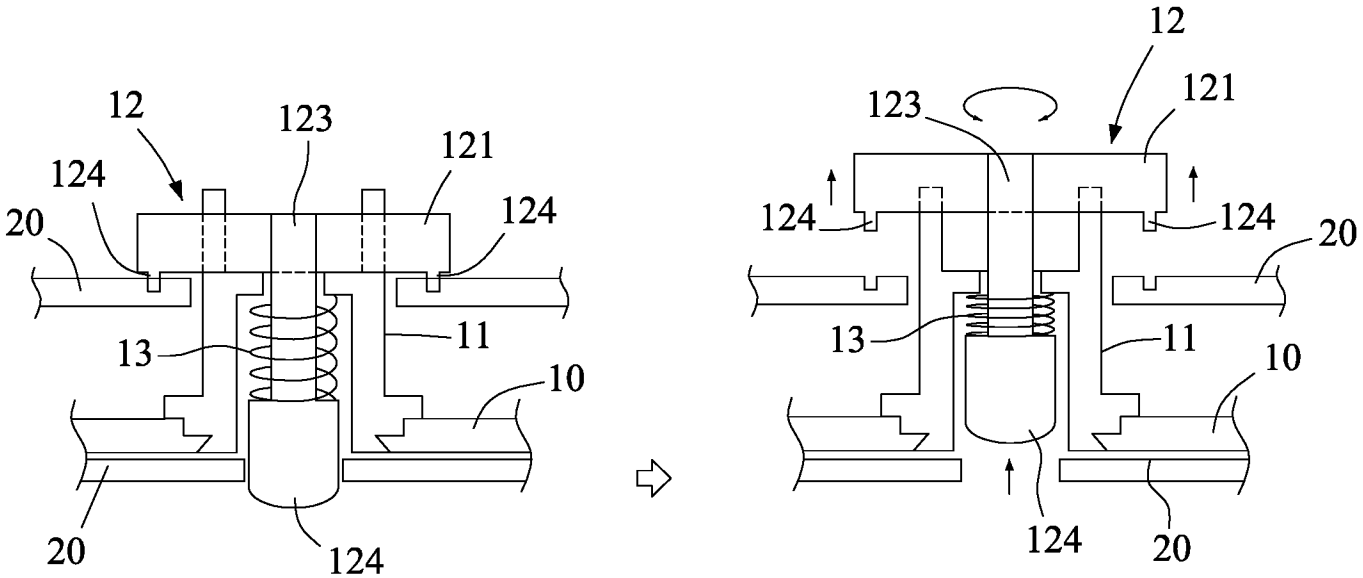
FIG. 5 is a schematic view of an operating state of an embodiment of the present disclosure.
Figure 6:
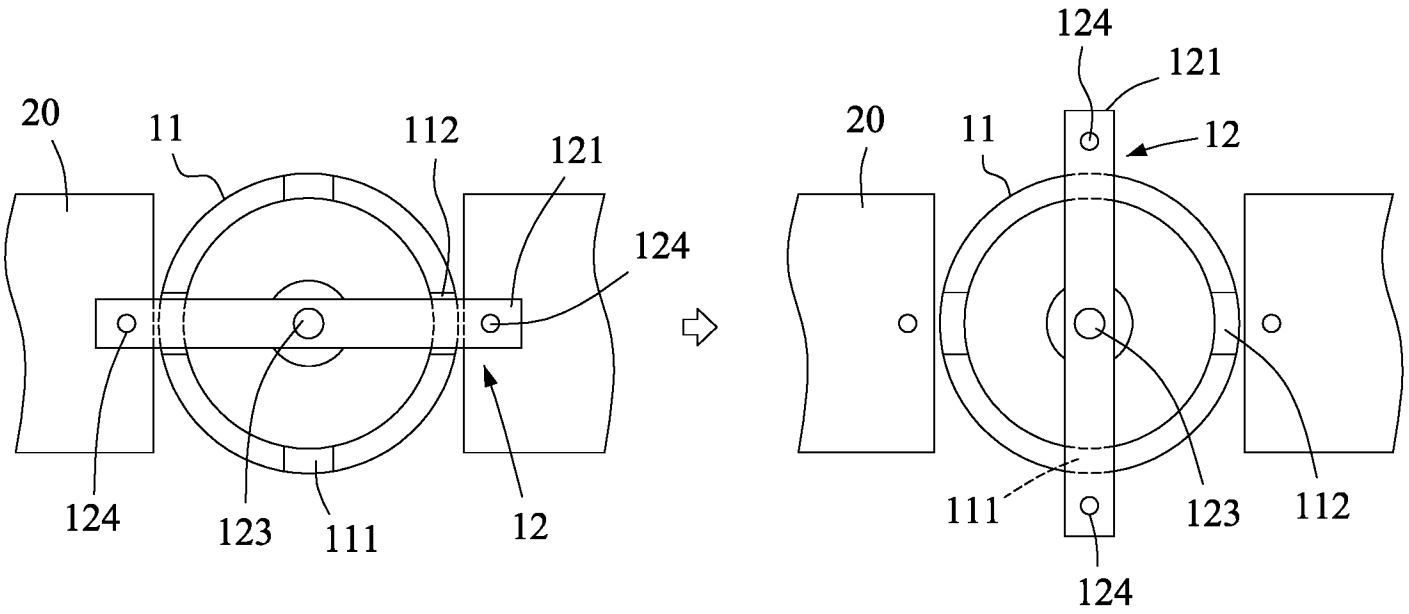
FIG. 6 is a schematic view of an operating state of an embodiment of the present disclosure.

Referring to FIGS. 4 to 6, in addition to the above embodiments, in an embodiment of the present disclosure, the corresponding section 121 of the fastener 12 may be provided with at least one additional clasp section 124. In an embodiment, two sides of a bottom surface of the corresponding section 121 may be respectively provided with a clasp section 124, so that the fastener 12 is provided with three clasp sections 124. The limiting segment 111 or the uplift segment 112 is an open space passing through the body section 11, or the limiting segment 111 or the uplift segment 112 is an open space passing through a side wall of the body section 11, and the open space in the present disclosure takes a groove as an embodiment.

Based on the above embodiment, the corresponding section 121 of the fastener 12 may be rotated to the limiting segment 111 at a lower position from the uplift segment 112 at a higher position, so that the corresponding section 121 is lowered from the lifting position to move to the limiting position to make the corresponding section 121 limited to the limiting segment 111, and thus the clasp sections 124 of the fastener 12 are simultaneously fastened to the attached object 20 for fastening combination. Further, the corresponding section 121 may be lifted from the limiting segment 111 of the lower position, so that the fastener 12 rotates to the uplift segment 112 of the higher position, and thus the corresponding section 121 is moved from the limiting position to the lifting position, in order to lift the clasp sections 124 while separating from the attached object 20. Thus, the fastening structure 1 can achieve stable combination and easy separation of the object 10 and the attached object 20.

Figure 7:
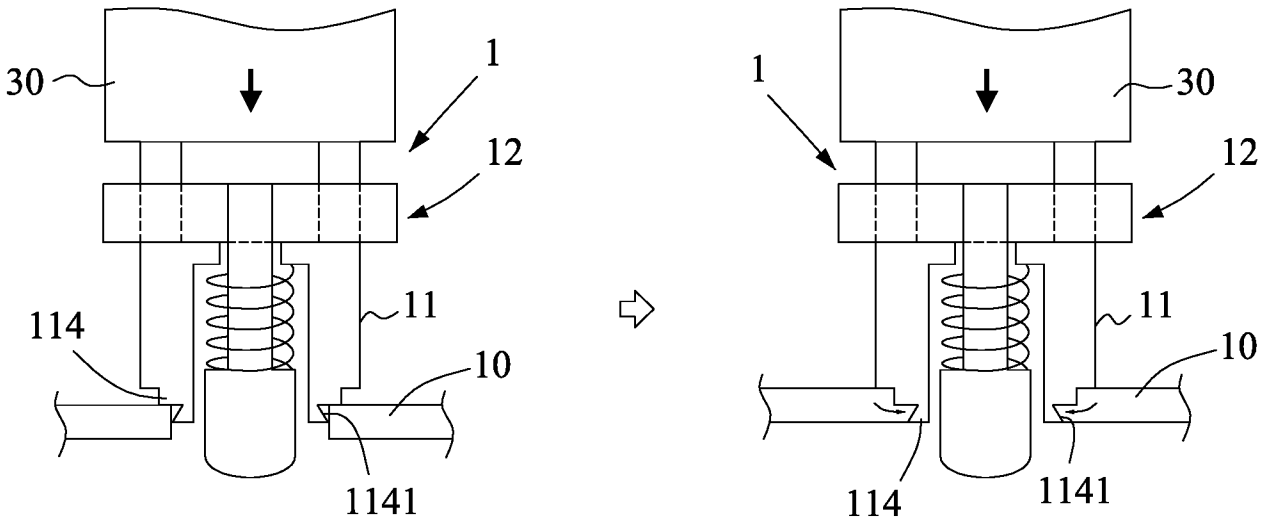
FIG. 7 is a schematic view of a connecting state an embodiment of the present disclosure.

Referring to FIG. 7, in addition to the above embodiments, in an embodiment of the present disclosure, an external force is applied to the top surface of the body section 11 by a tool 30 to make the connecting segment 114 of the body section 11 apply pressure to the object 10, so that the material of the object 10 flows into or enters a material storage space 1141 of the connecting segment 114. Thus, the fastening structure 1 is stably connected to the object 10 by the body section 11 thereof.

Figure 8:
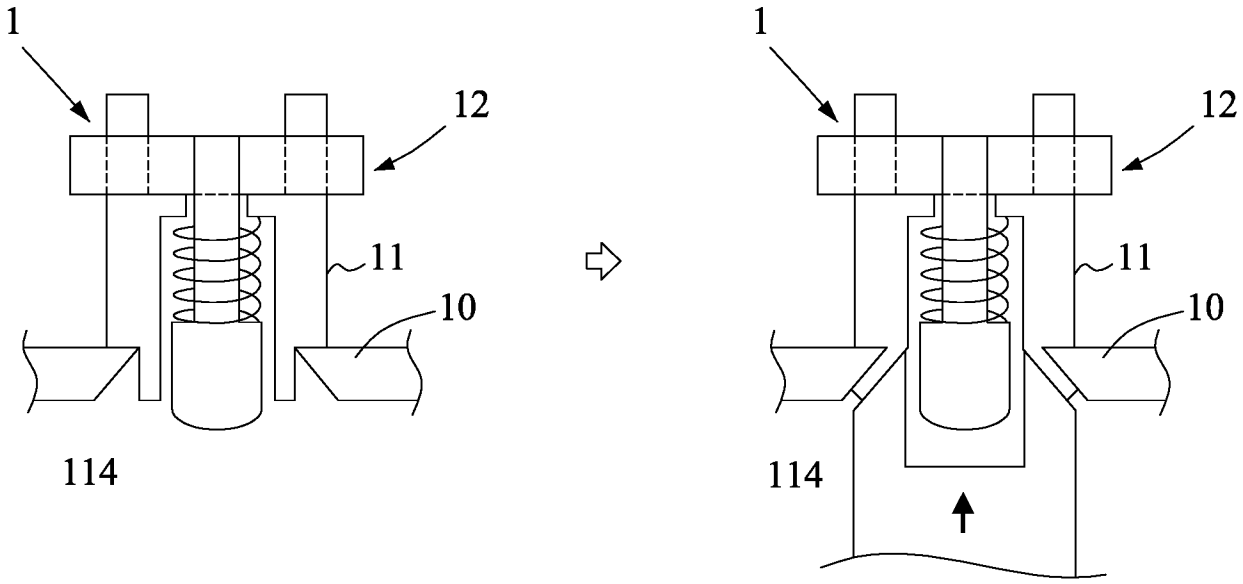
FIG. 8 is a schematic view of a connecting state of an embodiment of the present disclosure.

Referring to FIG. 8, in addition to the above embodiments, in an embodiment of the present disclosure, an external force is applied to the top or bottom of the body section 11 by a tool 30 to make the connecting segment 114 of the body section 11 expanded to the object 10. Thus, the fastening structure 1 is stably fastened to the object 10 by the body section 11 thereof.

Figure 9:
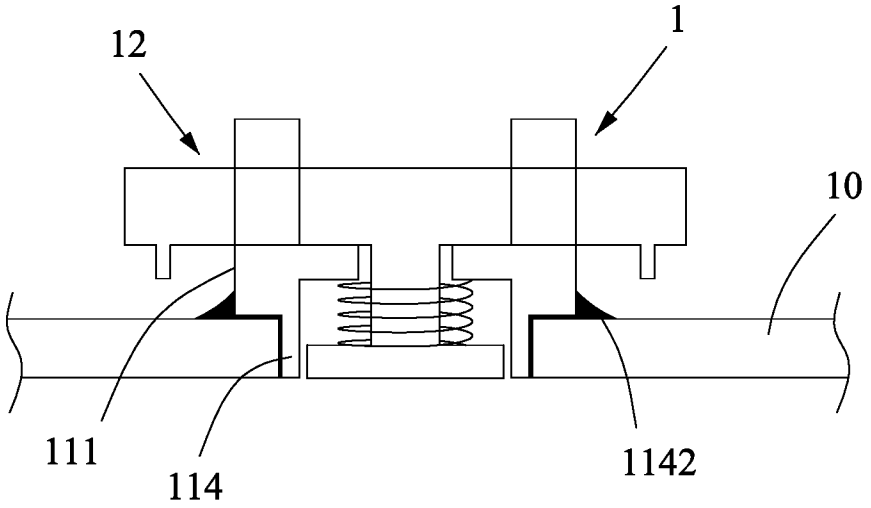
FIG. 9 is a schematic view of a connecting state of an embodiment of the present disclosure.

Referring to FIG. 9, in addition to the above embodiments, in an embodiment of the present disclosure, the connecting segment 114 has a solderable surface 1142, and the solderable surface 1142 can be heated to solder to the object 10. Thus, the fastening structure 1 is stably fastened to the object 10 by the body section 11 thereof.

Figure 10:
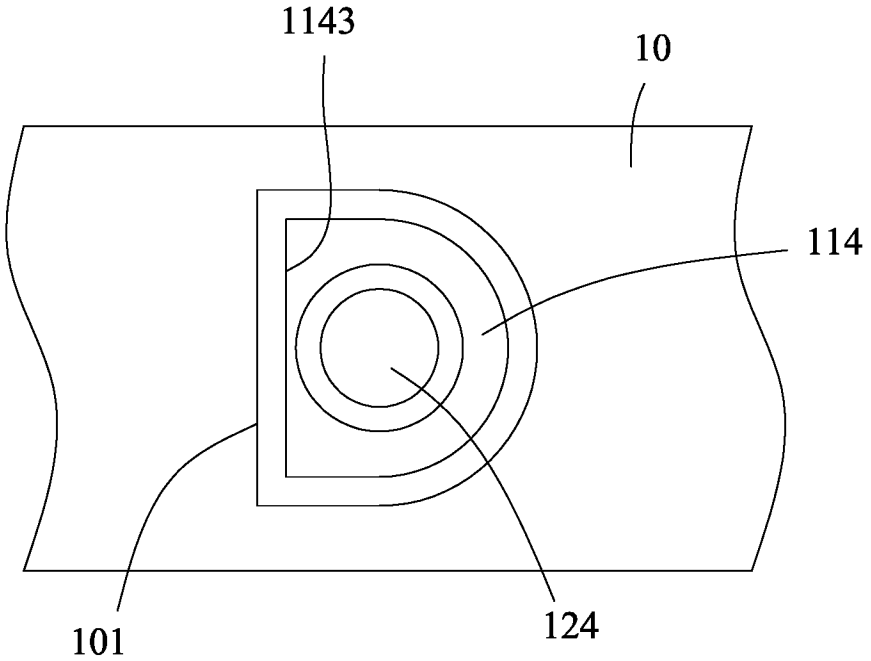
FIG. 10 is a schematic view of a connecting state of an embodiment of the present disclosure.

Referring to FIG. 10, in addition to the above embodiments, in an embodiment of the present disclosure, the connecting segment 114 has an anti-rotation segment 1143 (or a positioning part), the anti-rotation segment 1143 (or the positioning part) is used to anti-rotate or position the corresponding anti-rotation segment 101 of the object 10, thereby using the anti-rotation segment 1143 to cooperate with the corresponding anti-rotation segment 101 for anti-rotating, positioning, or limiting the fastening position or fastening direction of the clasp section 124, and then the present disclosure can further meet the needs of practical applications.

Figure 11:
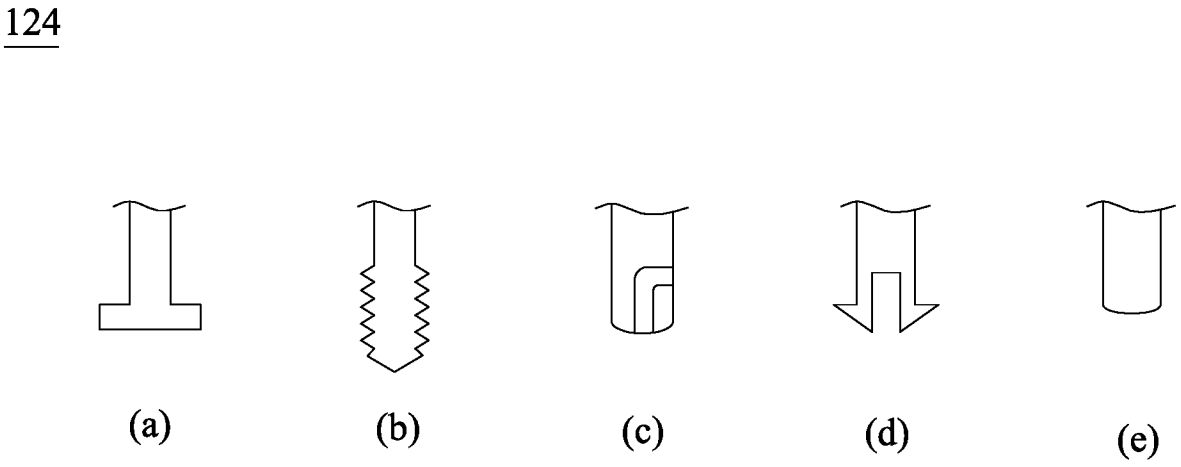
FIG. 11 is a schematic view of different types of a clasp sections of embodiments of the present disclosure.

Referring to FIG. 11, in addition to the above embodiments, in an embodiment of the present disclosure, the clasp section 124 of the fastener 12 may be a convex fastening body (such as part a of FIG. 11), a threaded body (such as part b of FIG. 11), an inner fastening body (such as part c of FIG. 11), an elastic fastening body (such as part d of FIG. 11), or a cylinder body (such as part e of FIG. 11), and then the present disclosure can further meet the needs of practical applications.

Figure 12:
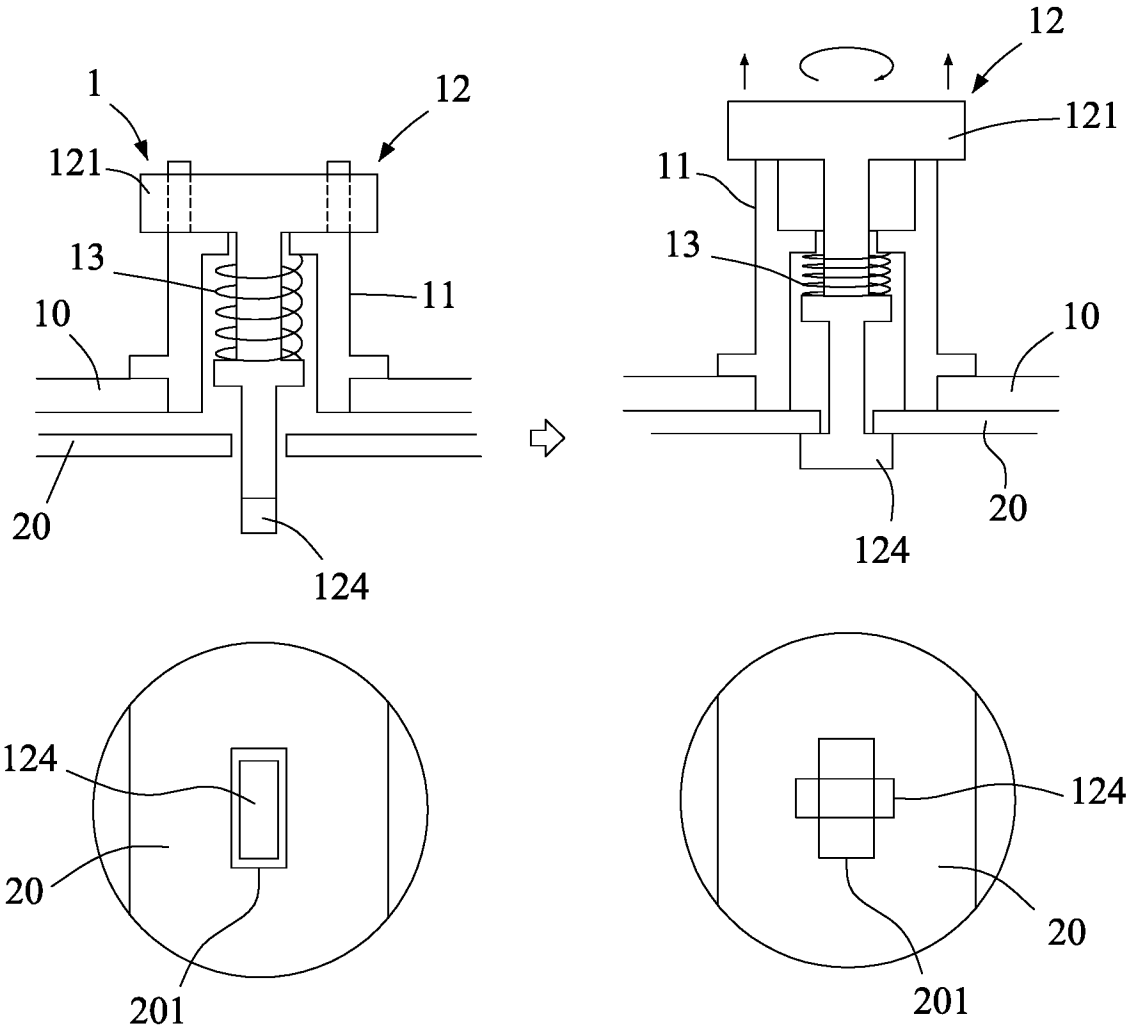
FIG. 12 is a schematic view of an operating state of an embodiment of the present disclosure.

Referring to FIG. 12, in addition to the above embodiments, in an embodiment of the present disclosure, the clasp section 124 of the fastener 12 is a convex fastening body, the clasp section 124 passes through an attached section 201 of the attached object 20, and rotates to the fastening position of the uplift segment 112, so that the attached object 20 is close to the position of the object 10. Thus, the fastening structure 1 can provide stable combination of the object 10 and the attached object 20.

Figure 13:
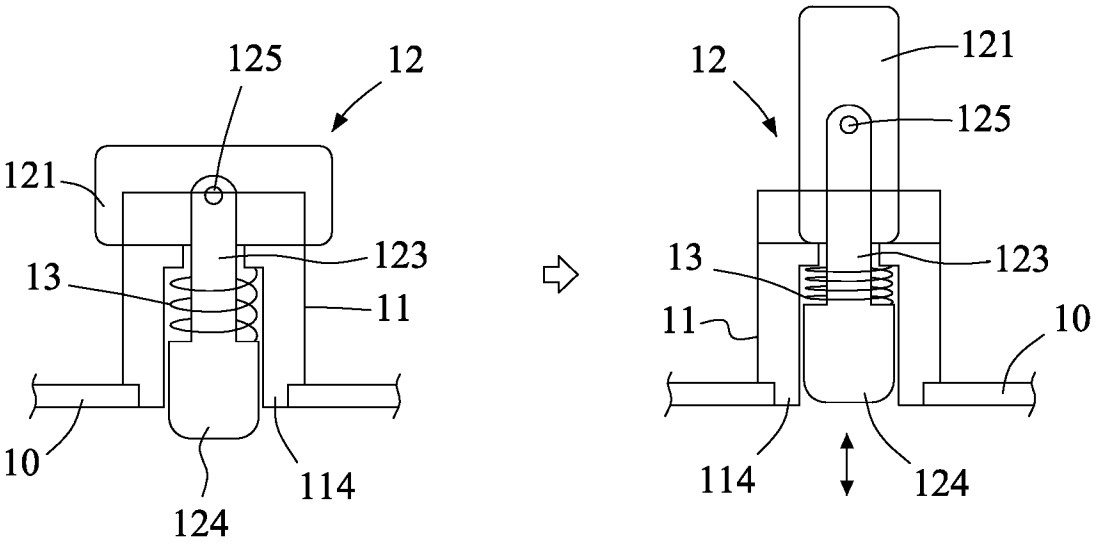
FIG. 13 is a schematic view of an operating state of an embodiment of the present disclosure.

Referring to FIG. 13, in addition to the above embodiments, in an embodiment of the present disclosure, the clasp section 124 of the fastener 12 is bolted with the corresponding section 121 by a bolted segment 125. When the corresponding section 121 rotates at the limiting segment 111, one side of the corresponding section 121 is lifted to drive the clasp section 124 up or in motion, thereby separating the clasp section 124 from the attached object 20, or resetting the corresponding section 121 to make the clasp section 124 move down, and then the clasp section 124 and the attached object 20 are fastened to each other. Thus, the fastening structure 1 can provide stable combination and easy separation of the object 10 and the attached object 20.

Figure 14:
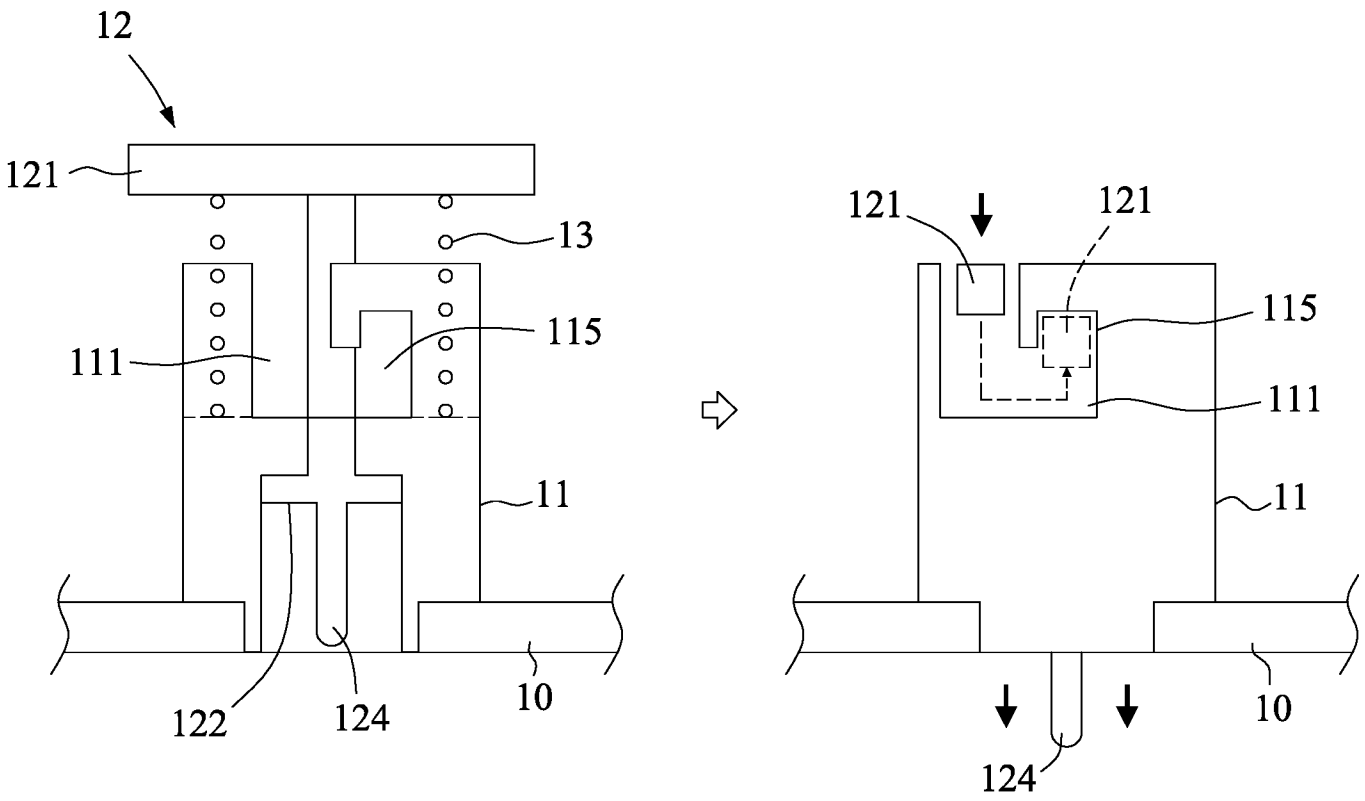
FIG. 14 is a schematic view of an operating state of an embodiment of the present disclosure.
Figure 15:
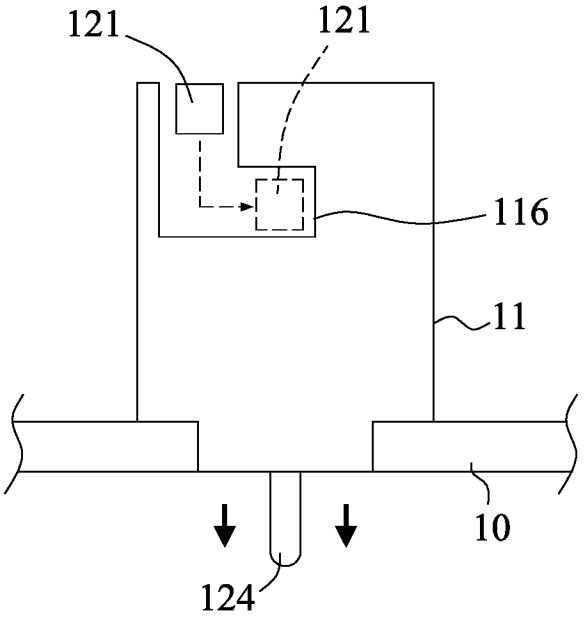
FIG. 15 is a schematic view of an operating state of an embodiment of the present disclosure.

Referring to FIGS. 14 and 15, in addition to the above embodiments, in an embodiment of the present disclosure, the corresponding section 121 presses the elastic component 13, so that the corresponding section 121 enters the limiting segment 111, and the elastic force of the elastic component 13 presses the limiting segment limiting segment 111 into a locking space 115 for limiting (as shown in FIG. 14), so that the clasp section 124 and the attached object 20 are fastened with each other. Thus, the fastening structure 1 can provide stable combination of the object 10 and the attached object 20.

Further, the corresponding section 121 may also press the elastic component 13, so that the corresponding section 121 enters the limiting segment 111, and the elastic force of the elastic component 13 presses the limiting segment 111 into a limiting space 116 (as shown in FIG. 15), so that the clasp section 124 and the attached object 20 are fastened with each other. Thus, the fastening structure 1 can provide stable combination of the object 10 and the attached object 20.

While the present invention has been described by means of specific embodiments, those skilled in the art should understand the above description is merely embodiments of the invention, and it should not be considered to limit the scope of the invention. It should be noted that all changes and substitutions which come within the meaning and range of equivalency of the embodiments are intended to be embraced in the scope of the invention. Therefore, the scope of the invention is defined by the claims.

What is claimed is:

1. A fastening structure, comprising a body section and a fastener, wherein the body section is movably combined with the fastener, the body section is provided with a limiting segment and an uplift segment, the uplift segment is a portion of a top of the body section, the limiting segment is another portion of the top of the body section and concaved relative to the uplift segment, the fastener is provided with a corresponding section rotatably connected to the body section, the limiting segment is used to make the corresponding section located at a limiting position to limit the corresponding section from lateral rotating, and the uplift segment is used to make the corresponding section located at a lifting position where the corresponding section is able to be rotated.

2. The fastening structure according to claim 1, wherein the corresponding section is provided with a clasp section.

3. The fastening structure according to claim 1, further comprising an elastic component, one end of the elastic component is abutted against the body section, and another end of the elastic component is abutted against the fastener, or the corresponding section presses an elastic component, so that the corresponding section enters the limiting segment, and an elastic force of the elastic component presses the limiting segment into a locking space for limiting, or the corresponding section presses an elastic component, so that the corresponding section enters the limiting segment, and an elastic force of the elastic component presses the limiting segment into a limiting space.

4. The fastening structure according to claim 1, wherein the corresponding section is lifted from the limiting segment, so that the fastener resists an elastic force of an elastic component, and when the corresponding section exceeds the limiting segment, the corresponding section is rotated to the uplift segment, in order to lift a clasp section, or the corresponding section is lifted to make the fastener rotate to the uplift segment, in order to lift a clasp section, or the corresponding section is lifted to make the fastener rotate to the uplift segment below a top surface of the body section, in order to lift a clasp section.

5. The fastening structure according to claim 1, wherein the body section is provided with a connecting segment, the connecting segment has an anti-rotation segment or a positioning part, the anti-rotation segment or the positioning part is used to anti-rotate or position an object, for anti-rotating, positioning, or limiting a fastening position or fastening direction of a clasp section.

6. The fastening structure according to claim 1, wherein the limiting segment or the uplift segment is an open space passing through the body section, or the limiting segment or the uplift segment is an open space passing through a side wall of the body section.

7. The fastening structure according to claim 1, wherein the fastener is provided with a clasp section, the clasp section is a convex fastening body, the clasp section passes through an attached section of an attached object, and rotates to a fastening position of the uplift segment.

8. The fastening structure according to claim 1, wherein the fastener is provided with a clasp section, the clasp section is bolted with the corresponding section, and the corresponding section rotates at the limiting segment to lift one side of the corresponding section to drive the clasp section up or in motion, or the corresponding section rotates at the limiting segment to lift one side of the corresponding section.

9. The fastening structure according to claim 1, wherein the corresponding section rotates at the limiting segment to lift one side of the corresponding section.

10. The fastening structure according to claim 1, wherein the corresponding section presses an elastic component, so that the corresponding section enters the limiting segment, and an elastic force of the elastic component presses the limiting segment into a locking space for limiting; or, the corresponding section presses an elastic component, so that the corresponding section enters the limiting segment, and an elastic force of the elastic component presses the limiting segment into a limiting space.

11. A fastening structure, comprising a body section and a fastener, wherein the body section is movably combined with the fastener, the body section is provided with a limiting segment and an uplift segment, the uplift segment is a portion of a top of the body section, the limiting segment is another portion of the top of the body section and concaved relative to the uplift segment, the fastener is provided with a corresponding section rotatably connected to the body section, the limiting segment is used to make the corresponding section located at a limiting position to limit the corresponding section from lateral rotating, and the uplift segment is used to make the corresponding section located at a lifting position where the corresponding section is able to be rotated;

wherein each of the limiting segment and the uplift segment is an open space passing through the body section, or each of the limiting segment and the uplift segment is an open space passing through a side wall of the body section.

12. A fastening structure, comprising a body section and a fastener, wherein the body section is movably combined with the fastener, the body section is provided with a limiting segment, the fastener is provided with a corresponding section rotatably connected to the body section, the limiting segment is a portion of a top of the body section and used to make the corresponding section located at a limiting position to limit the corresponding section from lateral rotating;

wherein the fastener is provided with a clasp section, the clasp section is bolted with the corresponding section, and the corresponding section at the limiting segment lifts one side of the corresponding section to rotationally drive the clasp section up or in motion, or the corresponding section rotates at the limiting segment to lift one side of the corresponding section.

13. A fastening structure, comprising a body section and a fastener, wherein the body section is movably combined with the fastener, the body section is provided with a limiting segment and an uplift segment, the uplift segment is a portion of a top of the body section, the limiting segment is another portion of the top and concaved relative to the uplift segment, the fastener is provided with a corresponding section, the limiting segment is used to make the corresponding section located at a limiting position, and the uplift segment is used to make the corresponding section located at a lifting position;

wherein the fastener is provided with a clasp section, the clasp section is bolted with the corresponding section, when the corresponding section is located at the limiting position, the clasp section extends outward of the body section and is fastened to an attached object.

14. A fastening structure, comprising a body section and a fastener, wherein the body section is movably combined with the fastener, the body section is provided with a limiting segment and an uplift segment, the uplift segment is a portion of a top of the body section, the limiting segment is another portion of the top and concaved relative to the uplift segment, the fastener is provided with a corresponding section, the limiting segment is used to make the corresponding section located at a limiting position, and the uplift segment is used to make the corresponding section located at a lifting position;

wherein the fastener is provided with a clasp section, the clasp section is bolted with the corresponding section, when the corresponding section is located at the limiting position, the clasp section extends outward of the body section and is fastened to an attached object;

wherein each of the limiting segment and the uplift segment is an open space passing through the body section, or each of the limiting segment and the uplift segment is an open space passing through a side wall of the body section.

15. A fastening structure, comprising a body section and a fastener, wherein the body section is movably combined with the fastener, the body section is provided with a limiting segment, the fastener is provided with a corresponding section, the limiting segment is a portion of a top of the body section and used to make the corresponding section located at a limiting position;

wherein the fastener is provided with a clasp section, the clasp section is bolted with the corresponding section, when the corresponding section is located at the limiting position, the clasp section extends outward of the body section and is fastened to an attached object;

wherein the corresponding section rotates at the limiting segment to lift one side of the corresponding section to drive the clasp section up or in motion, or the corresponding section rotates at the limiting segment to lift one side of the corresponding section.

* * * * *